US007029142B2

(12) United States Patent
Chen et al.

(10) Patent No.: US 7,029,142 B2
(45) Date of Patent: Apr. 18, 2006

(54) POWER TOOL

(75) Inventors: William Chen, Taichung (TW); Chun-Cheng Chen, Taichung (TW)

(73) Assignee: Mobiletron Electronics Co., Ltd., (TW)

( * ) Notice: Subject to any disclaimer, the term of this patent is extended or adjusted under 35 U.S.C. 154(b) by 58 days.

(21) Appl. No.: 10/779,654

(22) Filed: Feb. 18, 2004

(65) Prior Publication Data

US 2005/0135084 A1 Jun. 23, 2005

(30) Foreign Application Priority Data

Dec. 18, 2003 (TW) ..... 92222196 U

(51) Int. Cl.
*B25B 23/18* (2006.01)

(52) U.S. Cl. ..... 362/119; 362/109; 173/4

(58) Field of Classification Search ..... 173/4; 362/109, 119; 174/4
See application file for complete search history.

(56) References Cited

U.S. PATENT DOCUMENTS

| | | | | |
|---|---|---|---|---|
| 5,169,225 | A | 12/1992 | Palm | |
| 6,607,041 | B1 * | 8/2003 | Suzuki et al. | 173/4 |
| RE38,729 | E * | 4/2005 | Liu | 362/119 |
| 2004/0174699 | A1 * | 9/2004 | Minalga | 362/119 |

* cited by examiner

*Primary Examiner*—Sandra O'Shea
*Assistant Examiner*—Anabel Ton
(74) *Attorney, Agent, or Firm*—Bacon & Thomas, PLLC

(57) ABSTRACT

A power tool is composed of a shell body, a battery pack detachably mounted on the shell body, a lamp assembly mounted on the shell body for projecting the light on the working zone thereof, and a power detective circuit for detecting the power storage of the battery pack; the outcome of the power detection can be shown by the lamp assembly.

4 Claims, 4 Drawing Sheets

POWER TOOL

BACKGROUND OF THE INVENTION

1. Field of the Invention

The present invention relates generally to power tools powered by direct current (DC), and more particularly to a power tool having a lamp assembly for illuminating a working zone and displaying power storage.

2. Description of the Related Art

A conventional DC power tool, such as an electrical screwdriver or a power drill, requires none of power supply cords to be freely used in any geographical location. To accommodate more places, a power tool having a light source was invented, as disclosed in U.S. Pat. No. 5,169,225. The light source is composed of a bulb and a reflector. The reflector can reflect the light generated by the bulb towards a tool held by the power tool and towards the working zone around the tool, such that the power tool can be operated in dim or dark environment.

However, the battery has limited power energy and the user fails to know how much the remaining power energy of the battery is, such that the user has to carry backup batteries for potential replacement to incur inconvenience for the user.

SUMMARY OF THE INVENTION

The primary objective of the present invention is to provide a power tool that includes a lamp assembly for projecting the light on the working zone of the power tool and for indicating the power storage.

The foregoing objective of the present invention is attained by the power tool that is composed of a shell body, a battery pack detachably mounted on the shell body, a lamp assembly mounted on the shell body for projecting the light on the working zone thereof, and a power detective circuit for detecting the power storage of the battery pack; the outcome of the power detection can be shown by the lamp assembly.

DETAILED DESCRIPTION OF THE INVENTION

Figure 1:
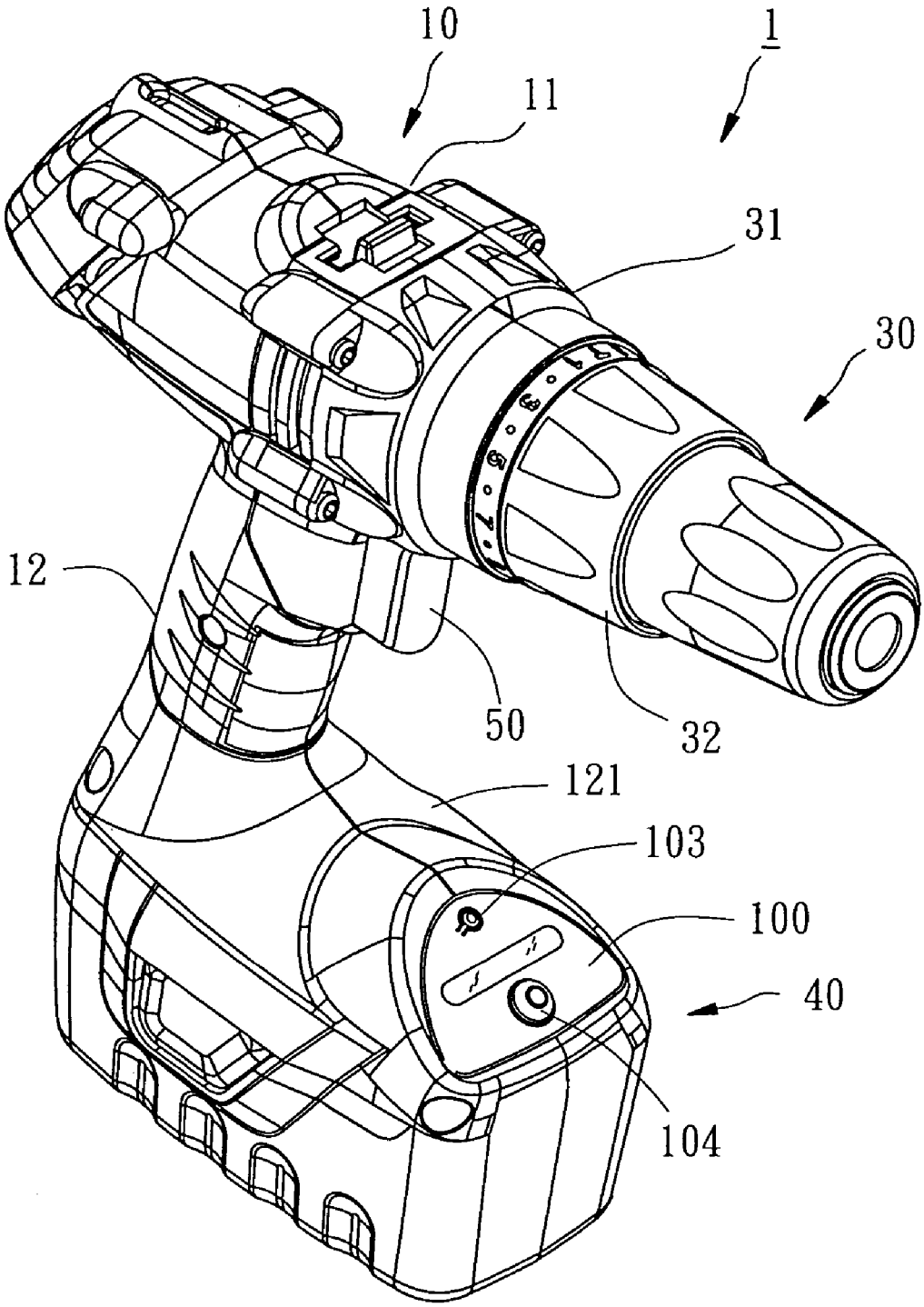
FIG. 1 is a perspective view of a preferred embodiment of the present invention.
Figure 2:
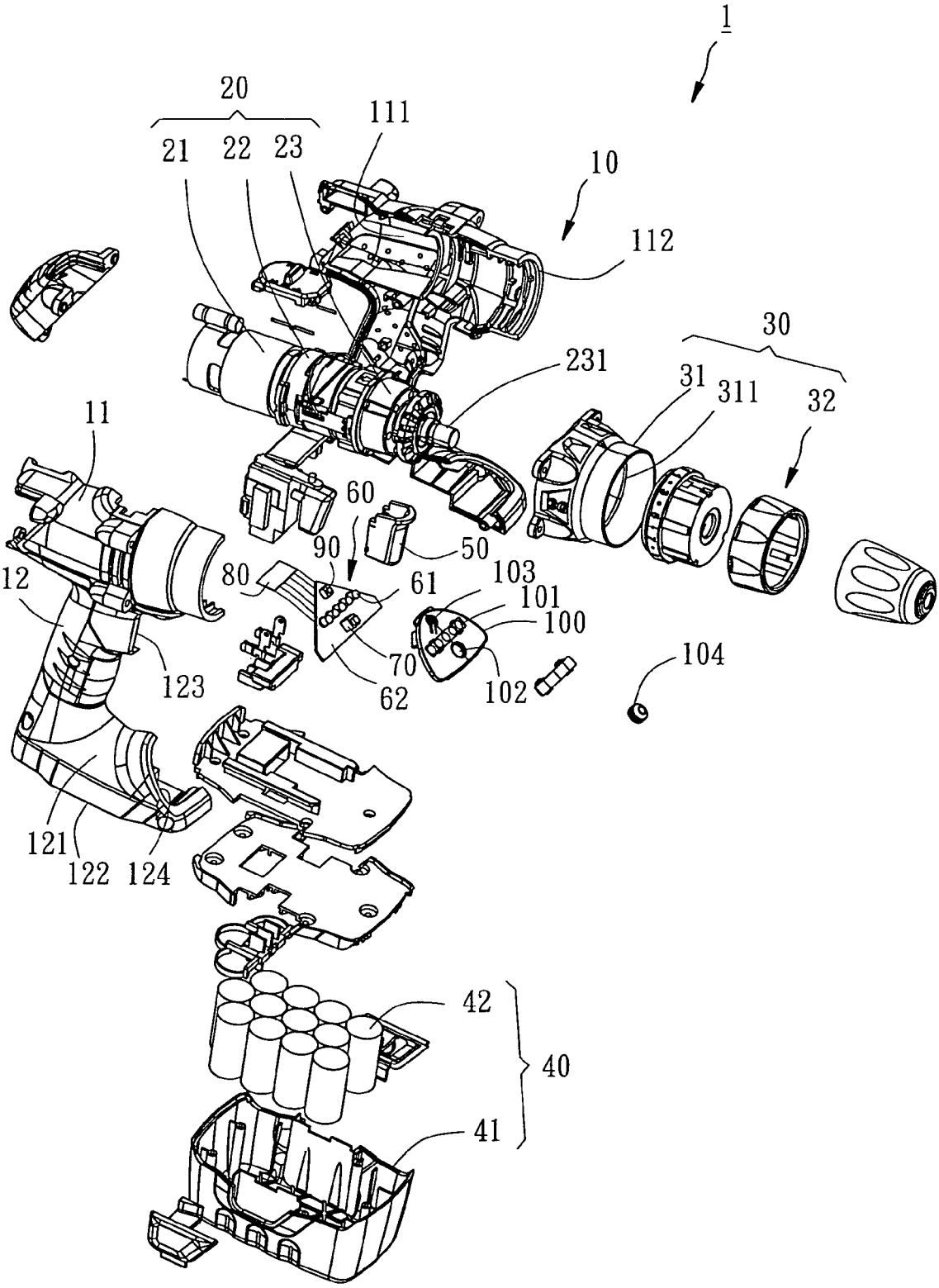
FIG. 2 is an exploded view of the preferred embodiment of the present invention.

Referring to FIGS. 1 and 2, a power tool constructed according to a preferred embodiment is embodied as an electric screwdriver 1 that is composed of a shell body 10, a driving mechanism 20, a tool holding mechanism 30, a battery pack 40, a trigger 50, a lamp assembly 60, a first switch 70, a power detective circuit 80, a second switch 90, a cover plate 100, and a switch protector 104.

The shell body 10 includes a first shell member 11 and a second shell member 12. The first shell member 11 has a chamber 111 formed inside and an opening 112 in communication with the chamber 111. The second shell member 12 extends downwards from a bottom of the first shell member 11 for a predetermined length at an included angle of more than 90°, including a connecting base 121 formed at a distal end thereof; the connecting base 121 has a connecting portion 122 at its distal end. The connecting portion 122 has a first opening 123 and a second opening 124. The first opening 123 approaches the first shell member 11 and the second opening 124 is positioned on the connecting base 121.

The driving mechanism 20 includes an electric motor 21, a reduction gearing 22, and a torsion control mechanism 23, which are interconnected in turn and mounted inside the chamber 111. The torsion control mechanism 23 extends out of the opening 112 of the first shell member 11 and has an output shaft 231.

The tool holding mechanism 30 includes a base 31 and a chuck 32. The base 31 is fixed on the first shell member 11, having a passage 311 for accommodating the torsion control mechanism 23. The chuck 32 is fitted to the passage 311 for holding a driver and is connected with the output shaft 231 to be driven by the output shaft 231 to drive the driver to rotate.

The battery pack 40 includes a housing 41 and a plurality of rechargeable batteries 42 mounted inside the housing 41. The battery pack 40 can be detachably connected with the connecting portion 122 of the second shell member 12 and can supply electricity for the electric motor 21.

The trigger 50 is mounted in the first opening 123 of the second shell member 12 for being pushed to activate a switch inside the shell body 10 to further control the battery pack 40 to supply electricity for the electric motor 21.

The lamp assembly 60 is mounted inside the second shell member 12, including five LED (light emitting diode) lamps 61 and a base plate 62 for fixing the five LED lamps 61. The LED lamps 61 are exposed outside the second opening 124 of the second shell member 12 and each project the light on a tool held on the tool holding mechanism 30 and within a predetermined range around the tool. The lamps 61 are supplied with electricity by the battery pack 40.

The first switch 70 is mounted on the base plate 62 for controlling the battery pack 41 to supply electricity for the lamps 61.

The power detective circuit 80 is disposed inside the second shell member 12 for detecting the remaining power energy of the battery pack 40 and is electrically connected with the lamps 61, such that the outcome of the power detection can be displayed by the number of the lamps 61 that are illuminated.

The second switch 90 is mounted on the base plate 62 for controlling the activation of the power detective circuit 80.

The cover plate 100 is shaped like the second opening 124, including five through holes 101 corresponding to the five LED lamps 61, a switch hole 102 corresponding to the first switch 70, and a push button 103 corresponding to the second switch 90. The cover plate 100 is mounted at the second opening 124 and over the base plate 62 to enable the lamps 61 and the first switch 70 to respectively run through the through hole 101 and the switch hole 102 and to enable the push button 103 to contact against the second switch 90.

The switch protector 104 is disposed on the cover plate 100 and is fitted onto the first switch 70.

While operating the electric screwdriver 1, the user can hold the second shell member 12 and enable the forefinger to pull the trigger 50 to activate the electric motor 21; meanwhile, the chuck 32 of the tool holding mechanism 30 is driven to rotate via the reduction gearing 22 and the torsion control mechanism 23 to further drive the driver to screw a screw on/off.

Figure 3:
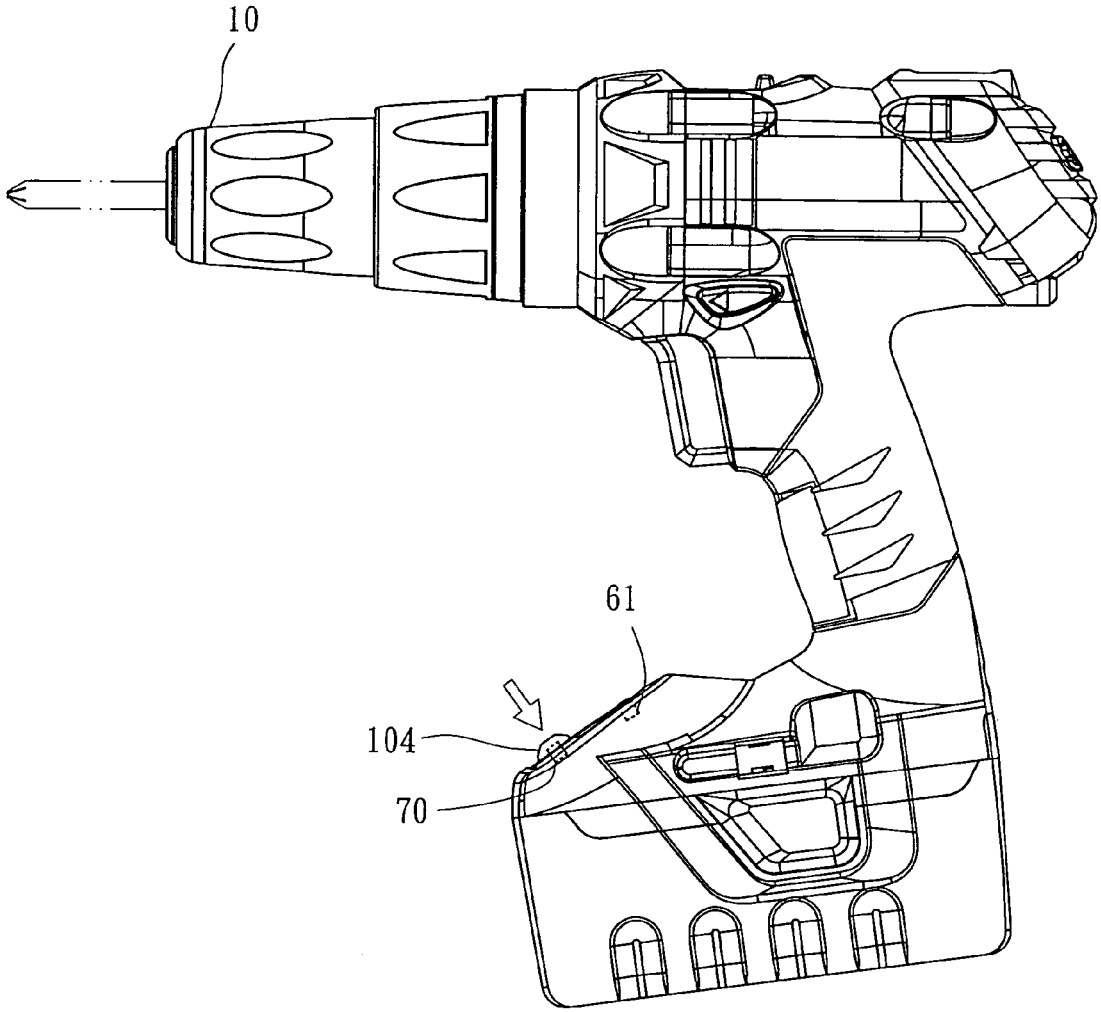
FIG. 3 is a schematic view of the preferred embodiment of the present invention at work.

Referring to FIG. 3, when the electric screwdriver 1 is operated in a dim or dark place, the user can push the first switch 70 to activate the lamps 61 to illuminate, and meanwhile, the lamps 61 project the light on the driver held on the chuck 32 and on a section around the driver, such that the user can work conveniently.

Figure 4:
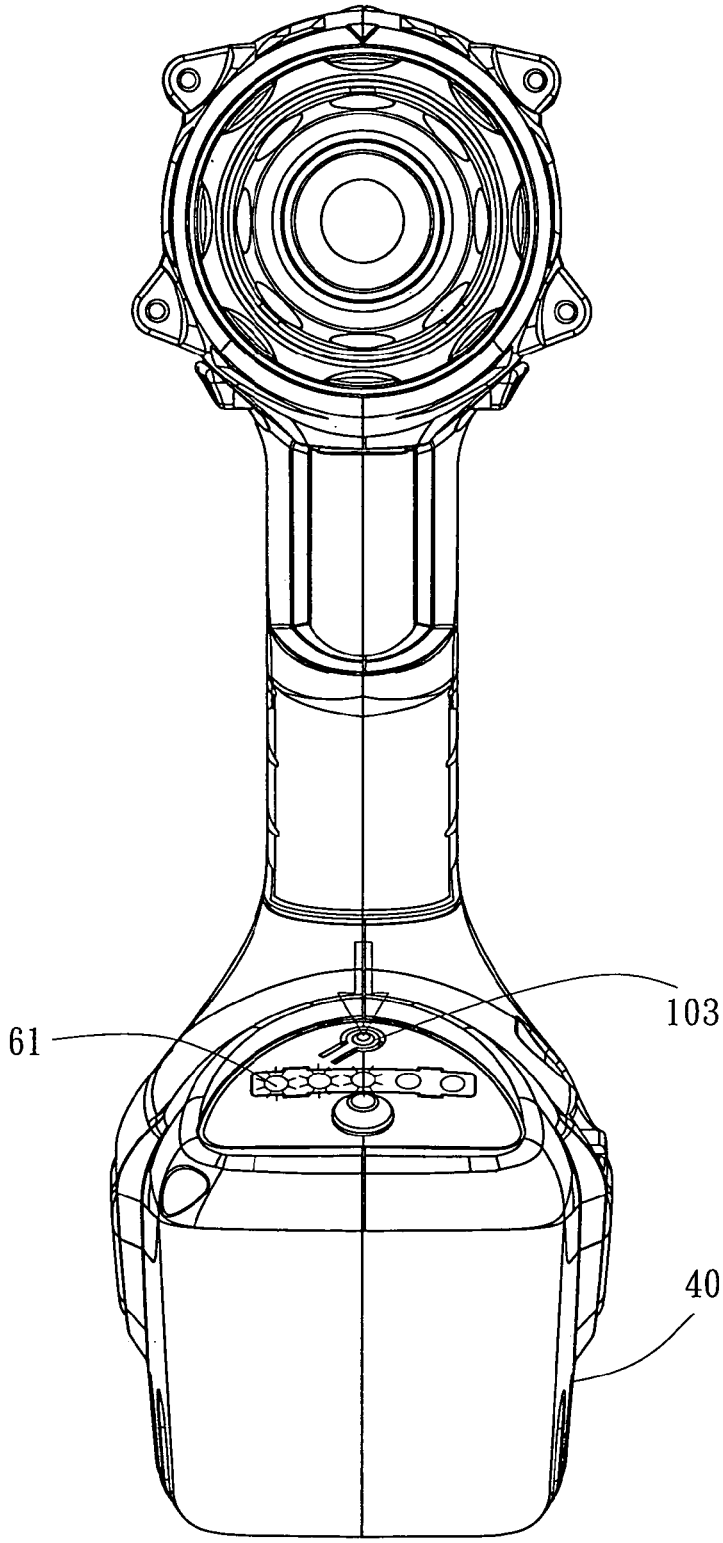
FIG. 4 is another schematic view of the preferred embodiment of the present invention at work.

Referring to FIG. 4, when the user intends to know the remaining power energy of the battery pack 40, the user can push the button 103 to push the second switch 90 to further activate the power detective circuit 80 so as to detect the remaining power energy of the battery pack 40 and to display the outcome of the power detection by the number of the lamps 61 that are illuminated.

Briefly, the electric screwdriver not only functions as illumination and power display but also, especially, has the one lamp assembly functioning as the illumination and the power display at the same time, such that it is unnecessary to structurally enlarge the electric screwdriver while multiplying the functions.

In addition, the present invention can be alternatively embodied. For example, the first and second switches can be integrally formed as a single switch that can also function as the illumination and the power detection/display.

What is claimed is:

1. A power tool comprising:

a shell body having a first shell member and a second shell member extending outwards for a length from said first shell member, the second shell member having an opening defined there through;

an electric motor mounted inside said first shell member;

a tool holding mechanism powered by said electric motor and mounted on said first shell member for holding a tool;

a lamp assembly comprising a base plate mounted inside said second shell member and at least two independent lamps fixedly mounted on said base plate and exposed outside said opening of said second shell member for projecting light on said tool, the projection of the light being within a predetermined range around said tool;

a battery pack detachably connected to said second shell member for supplying electricity for said electric motor and said lamps;

a first switch mounted on said base plate for controlling said battery pack to supply electricity for said lamps;

a power detective circuit for detecting power storage of said battery pack, said power detective circuit having a detection outcome output electrically connected with said lamps for displaying the power storage by a number of said lamps that are illuminated; and a second switch mounted on said base plate for controlling the display of the power storage of said battery pack; and a cover plate connected to said second shell member to seal said opening, said cover plate having through holes corresponding in position to each of said lamps.

2. The power tool as defined in claim 1, wherein said cover plate further comprises a switch hole, and said first switch extends through the switch hole.

3. The power tool as defined in claim 1, wherein said cover plate further comprises a push button contacting against said second switch.

4. The power tool as defined in claim 2 further comprising a switch protector disposed on said cover plate and fitted onto said first switch.

* * * * *